US006884446B1

(12) United States Patent
Underwood et al.

(10) Patent No.: US 6,884,446 B1
(45) Date of Patent: Apr. 26, 2005

(54) ARTICLE FOR BROWNING AND FLAVORING FOODSTUFFS

(75) Inventors: Gary L. Underwood, Manitowoc, WI (US); Jeffrey J. Rozum, Cato, WI (US)

(73) Assignee: Red Arrow Products Co., LLC, Manitowoc, WI (US)

( * ) Notice: Subject to any disclaimer, the term of this patent is extended or adjusted under 35 U.S.C. 154(b) by 574 days.

(21) Appl. No.: 09/626,039

(22) Filed: Jul. 27, 2000

(51) Int. Cl.[7] ..... A23L 1/27; H05B 6/80

(52) U.S. Cl. ..... 426/90; 426/243; 426/262; 219/730

(58) Field of Search ..... 426/90, 107, 113, 426/125, 248, 234, 135, 262; 219/730

(56) References Cited

U.S. PATENT DOCUMENTS

| | | | | | |
|---|---|---|---|---|---|
| 3,106,473 | A | | 10/1963 | Hollenbeck | 99/229 |
| 3,330,669 | A | * | 7/1967 | Hollenbeck | |
| 4,230,924 | A | * | 10/1980 | Brastad et al. | 219/10.55 E |
| 4,299,851 | A | * | 11/1981 | Lowe | 426/132 |
| 4,735,812 | A | * | 4/1988 | Bryson et al. | 426/262 |
| 4,876,108 | A | | 10/1989 | Underwood et al. | 426/650 |
| 4,888,188 | A | * | 12/1989 | Castner, Sr. et al. | 426/109 |
| 4,892,782 | A | * | 1/1990 | Fisher et al. | 428/240 |
| 4,927,991 | A | | 5/1990 | Wendt et al. | 219/10.55 |
| 5,252,188 | A | | 10/1993 | Stradal et al. | 203/43 |
| 5,270,067 | A | | 12/1993 | Underwood et al. | 426/138 |
| 5,286,504 | A | * | 2/1994 | Sheen et al. | 426/243 |
| 5,292,541 | A | | 3/1994 | Underwood et al. | 426/250 |
| 5,322,984 | A | | 6/1994 | Habeger, Jr. et al. | 219/728 |
| 5,393,542 | A | | 2/1995 | Stradal et al. | 426/241 |
| 5,397,582 | A | | 3/1995 | Underwood et al. | 426/250 |
| 5,741,533 | A | * | 4/1998 | Lorenzo Moore et al. | 426/112 |
| 5,756,140 | A | * | 5/1998 | Shoop et al. | 426/302 |
| 5,858,487 | A | | 1/1999 | Boehler et al. | 428/34.3 |
| 5,952,027 | A | * | 9/1999 | Singh | 426/305 |

FOREIGN PATENT DOCUMENTS

| | | | |
|---|---|---|---|
| CA | 2230432 | 8/1998 | |
| EP | 0 303 511 | 2/1989 | A23L/1/025 |
| EP | 0 839 737 | 5/1998 | B65D/81/34 |
| EP | 0 943 558 | 9/1999 | B63D/81/34 |
| WO | WO 91/03917 | 3/1991 | H05B/6/64 |
| WO | WO 94/08461 | 4/1994 | A23B/4/044 |
| WO | WO 98/08752 | 3/1998 | B65D/81/34 |
| WO | WO 98/35887 | 8/1998 | B65D/81/34 |
| WO | WO 98/53712 | 12/1998 | A23P/1/08 |

* cited by examiner

*Primary Examiner*—Milton I. Cano
*Assistant Examiner*—Robert Madsen
(74) *Attorney, Agent, or Firm*—Marshall, Gerstein & Borun LLP

(57) ABSTRACT

An article that indirectly browns and/or flavors foodstuffs, a method of indirectly browning and/or flavoring foodstuffs, and a browned and/or flavored foodstuff provided by the article are disclosed. More specifically, the articles and processes to brown and/or flavor foodstuffs utilize a heated susceptor, such as a plastic film, metal foil, cardboard, or paper, treated with a browning and/or flavoring composition, such as a composition containing hydroxyacetaldehyde.

6 Claims, No Drawings

ARTICLE FOR BROWNING AND FLAVORING FOODSTUFFS

FIELD OF THE INVENTION

The present invention relates to an article that indirectly browns and/or flavors foodstuffs, and to a method of indirectly browning and/or flavoring a foodstuff. More specifically, the present invention relates to articles and methods of producing browned and/or flavored foodstuffs from a heated susceptor, such as metal foil, cardboard, or paper, treated with a browning and/or flavoring composition containing a reactive aldehyde, such as hydroxyacetaldehyde (HAA).

BACKGROUND OF THE INVENTION

Consumers desire dough-based foodstuffs, like pies, pie crusts, biscuits, dinner rolls, and bagels, having a golden-brown exterior and a baked flavor. The traditional method of achieving a brown color and baked flavor on a dough-based foodstuff, like a bakery good, is baking the foodstuff in a conventional oven. These bakery goods can be prepared, refrigerated or frozen, and later reheated to attain the esthetic brown color that consumers equate to palatability.

Traditional baking, however, has disadvantages. One disadvantage is the cost that traditional baking adds to the production of dough-based foodstuff products. A traditional baking step is associated with a relatively high labor and energy cost, which can be wasted if the product is neither used nor consumed immediately, or is subsequently stored, refrigerated, or frozen before the product is consumed. Consumers, food processors, and bakeries, therefore, have sought substitutes for conventional baking that duplicate the brown color and baked flavor imparted to dough-based foodstuffs and that are more economical.

The use of browning and/or flavoring compositions as a replacement for subjecting a foodstuff to a flavoring and browning process step has become a standard industry practice. For example, pyrolysis liquids and dry powder formulations, e.g., liquid smoke compositions and compositions containing hydroxyacetaldehyde (HAA), are useful as a replacement for the browning and flavoring of a foodstuff by direct contact of a foodstuff with smoke produced from burning wood. When applied to the surface of proteinaceous foodstuffs, components of the liquid smoke compositions give the foodstuff a characteristic smoke flavor, and other components react with the proteins to produce a browning typical of smoked foodstuffs. HAA formulations typically are essentially free of food flavoring components, but impart a golden brown color to foodstuffs. Hollenbeck U.S. Pat. No. 3,106,473, Underwood et al. U.S. Pat. No. 4,876,108, and Stradal et al. U.S. Pat. No. 5,252,188, each incorporated herein by reference, are examples of patents that disclose such browning and flavoring compositions, which can be applied directly to a foodstuff to impart a golden brown color and/or a smokey flavor to the foodstuff.

The direct application of such browning and/or flavoring compositions to a foodstuff has disadvantages. For example, direct application of such browning and flavoring compositions to a foodstuff can lead to the premature and undesirable browning and flavoring of a foodstuff during storage, refrigeration, or freezing. Because of this particular disadvantage, conventional baking techniques are still used to cook the majority of bakery goods.

Likewise, a substantial effort has been expended to provide materials or articles that permit foodstuffs to be cooked in a microwave oven, yet exhibit the esthetic properties obtained by cooking in a conventional oven. The most popular device is the plain or patterned susceptor. Plain and patterned susceptors are convenient for use in microwave food cooking applications, are low in cost, and can be quite effective in generating local surface heat which contributes to browning and crisping food surfaces. A microwave susceptor typically comprises a layer of metallized plastic film laminated to a dimensionally stable substrate, such as paperboard. The thickness of the metal is such that the metal absorbs microwave energy and converts it into heat. Such susceptors are commonly used commercially to brown and crispen food in contact with the susceptor. Habeger Jr. et al. U.S. Pat. No. 5,322,984, Wendt et al., U.S. Pat. No. 4,927,991, WO 98/08752 and WO 98/35887, and European Patent Application 943,558, each incorporated herein by reference, disclose variations of patterned susceptors that can be used to help brown and crispen a foodstuff heated in a microwave oven.

Boehler et al. U.S. Pat. No. 5,858,487 discloses a food wrap for a microwavable food. The wrap has a laminated structure including: (a) a susceptor layer, (b) a coating layer containing flavors, fragrances, and mixtures in encapsulated form. The capsules release the flavors and fragrances when the food wrap is subjected to microwave heating.

The use of susceptors in microwave foodstuff cooking also has disadvantages. In general, susceptors alone do not have the ability to provide a uniform brown color and crisp foodstuff, or the ability to adapt to variations in individual oven field strengths and different loading conditions of the foodstuff. Therefore, unlike heating in a conventional oven, present day susceptors are unable to uniformly and reliably heat, brown, and crispen foodstuffs heated in a microwave oven.

Ideally, it would be advantageous to provide a new method of browning and/or flavoring foodstuffs heated in a microwave oven, which results in uniformly and reliably heated, browned, and/or flavored foodstuffs that possess the esthetic properties of a foodstuff cooked in a conventional oven. It also would be advantageous if the new method imparted the desired esthetic effects of browning and/or flavoring only upon heating, and avoided premature browning while stored, refrigerated, or frozen prior to heating. It also would be desirable if the browning and/or flavoring method could be used both on foodstuffs that are prepared, heated, and sold fresh; refrigerated, or frozen, like in bakeries, and on pre-prepared foodstuffs that are refrigerated or frozen, and later heated, such as pies, pie crusts, and dinner rolls. It would also be advantageous if the browning and/or flavoring method imparted the desired esthetic effects to both microwavable foodstuffs and to foodstuffs previously considered as nonmicrowavable.

A need exists, therefore, for a browning and/or flavoring method and article that overcomes the problems and disadvantages associated with directly applying a browning and/or flavoring composition to the foodstuff, and especially with respect to foodstuffs which are stored, refrigerated, or frozen for a period of time before heating and consumption. The present browning and/or flavoring method and article overcome these disadvantages, while providing foodstuffs having the esthetic properties desired and required by consumers. In addition, the present browning and/or flavoring method and article can be used with all types of foodstuffs irrespective of their intended method of heating, e.g., microwavable or nonmicrowavable foods. The present browning and/or flavoring method and article provide a heated foodstuff with the palatability and esthetic properties equivalent to a foodstuff baked in a conventional oven, while reducing the costs associated with preparing the foodstuffs, without adversely affecting the taste or odor of the foodstuff.

SUMMARY OF THE INVENTION

The present invention relates to an article comprising a susceptor treated with a sufficient amount of a browning and/or flavoring composition. The composition preferably contains hydroxyacetaldehyde. The resulting article is capable of imparting a desirable color and/or flavor to a foodstuff, preferably brown and/or smokey, respectively, when foodstuffs such as a bakery goods, and specifically pies or pie crusts, are heated. When the treated susceptor is heated in the presence of the foodstuff, the foodstuff acquires the desirable brown color and/or flavor properties imparted by the composition. A foodstuff is not browned and/or flavored by simply having the foodstuff in the presence of the susceptor treated with the browning and/or flavoring composition. Heating or cooking the foodstuff in the presence of the treated susceptor is required to release the colorants and flavorants from the susceptor to brown and/or flavor the foodstuff.

The present invention provides a method of producing such an article by treating a suitable susceptor with a liquid or dry formulation of a browning and/or flavoring composition. A browning and/or flavoring composition useful to practice this invention preferably contains hydroxyacetaldehyde (HAA). HAA imparts a golden brown color, and essentially no taste, to heated foodstuffs. The production and use of HAA to brown a foodstuff are disclosed in Underwood et al. U.S. Pat. Nos. 5,292,541 and 5,397,592, and Stradal et al. U.S. Pat. No. 5,393,542, each incorporated herein by reference. Commercial sources of hydroxyacetaldehyde include MAILLOSE® Dry, MAILLOSE® liquid, MAILLOSE® 45, SELECT 24 P, or mixtures thereof, all available from Red Arrow Products LLC., Manitowoc, Wis. Such solutions/mixtures typically contain about 0.001% to about 35%, by weight, hydroxyacetaldehyde. Flavor can be imparted to a heated foodstuff by incorporating a standard liquid smoke composition into or on the susceptor. Standard liquid smoke compositions contain phenols and acids to impart a smokey flavor to the foodstuff, and contain carbonyl compounds to impart browning.

In practicing this invention, a variety of susceptors can be used. The susceptor can be a solid, porous material, for example, a filter pad disk or cardboard (which can include the packaging of the foodstuff), or a separate material. Suitable materials also include metal foils, for example, aluminum foil, plastics, for example plastic films, and combinations of all before mentioned materials. Suitable susceptors can have a variety of shapes and sizes. A browning and/or flavoring composition is applied as a relatively thin coating, either as a liquid or solid, that adheres to at least one surface of a susceptor. The application of more than one browning and/or flavoring material to the susceptor can be done sequentially or simultaneously.

The present invention provides a method of producing browned and flavored foodstuffs by heating the treated susceptor in the presence of the foodstuff. The browning and/or flavoring components of the applied composition are volatilized from the susceptor, and contact the foodstuff to impart a desirable brown color and/or flavor to the foodstuff. The susceptor can be in contact with the foodstuff, or positioned proximal to the foodstuff. The treated susceptor imparts a level of taste or odor to the foodstuff related to such factors as whether only a browning composition or a flavoring composition is used or whether a browning and flavoring composition is used, whether all areas on the foodstuff are exposed, and the proximity of the susceptor to the foodstuff.

If HAA is a component of the browning and/or flavoring composition, heating a treated susceptor at typical cooking temperatures in a regular oven, convection oven, microwave oven, toaster, or other heating device, but preferably a microwave oven, volatilizes the HAA and induces browning as a result of HAA reacting with the foodstuff proteins.

Foodstuffs that can be browned by HAA include cheeses, meats, sausages and other encased food products, poultry, fish, and bakery products. The high browning capability of HAA makes the HAA incorporated into or onto a susceptor particularly useful in browning bakery products, such as biscuits, dinner rolls, pies, pie crusts, bagels, and puff pastries, that typically are cooked in a microwave.

These and other aspects and novel features of the present invention will become apparent from the following detailed description of the preferred embodiments.

DETAILED DESCRIPTION OF THE PREFERRED EMBODIMENTS

One aspect of the present invention is to provide a susceptor that can indirectly brown and/or flavor a foodstuff. The article is obtained by treating a susceptor with a browning and/or flavoring composition. The treated susceptor is heated, preferably in a microwave oven, in the presence of the foodstuff to brown and/or flavor the foodstuff. The components of the browning and/or flavoring treatment are volatilized from the susceptor, contact the foodstuff, and impart a desirable brown color and/or flavor to the foodstuff. For example, if bakery goods are heated in a microwave oven, the heated foodstuff exhibits esthetic properties similar or identical to a foodstuff baked in a convection oven.

In accordance with another important aspect, the present invention provides a method of manufacturing the treated susceptor, and an article comprising the treated susceptor and a heatable foodstuff. The treated susceptor is manufactured by applying a browning and/or flavoring composition to at least one surface of a susceptor as a relatively thin coating. The coated, or treated, susceptor then can be packaged with a heatable foodstuff. Heating the microwavable or nonmicrowavable foodstuff, for example a bakery good, such as a pie or pie crust, in the presence of the treated susceptor provides a heated foodstuff having a baked appearance of golden brown crust and/or a smokey flavor that consumers equate to palatability.

In one aspect of this invention, imparting a brown color without a strong or an undesirable flavor can be a notable advantage. For example, conventional liquid smoke products derived from wood generally are applied to foodstuffs at in sufficiently high amounts to impart browning and flavor to the foodstuff. However, the amount of smoke flavor that is imparted often is more intense than desired by consumers. The use of HAA to treat a susceptor allows a food processor to achieve a desired brown color, while imparting little or substantially no detectable flavoring to the foodstuff, after heating.

A browning composition that is particularly useful in practicing the present invention contains hydroxyacetaldehyde (HAA). One preferred browning composition of the present invention is a dry composition comprising: a) HAA, and b) a food starch, a maltodextrin, a food gum, or a mixture thereof. A preferred browning and/or flavoring composition comprises about 0.01% to about 35% by weight HAA, and typically about 0.5% to about 25%, by weight. To achieve the full advantage of the present invention, the composition contains about 1% to about 20% HAA, by weight. A sufficient amount of HAA is applied to the susceptor to impart a rich golden brown color to a foodstuff heated in a microwave.

To impart browning to a microwavable bakery product, the application of about 0.1 to about 0.5% by weight HAA to a susceptor provides a desirable golden brown color to the foodstuff. To impart browning to a nonmicrowavable bakery product, the application of about a 0.1 to about 0.5% by weight HAA to a susceptor provides a desirable golden brown color to the pie or pie crust. It should be noted, however, that an HAA concentration as low as 0.05% can impart a noticeable golden brown color to microwaved pies or pie crusts. In preferred embodiments, the source of hydroxyacetaldehyde is MAILLOSE® Dry, MAILLOSE® liquid, MAILLOSE® 45, SELECT 24 P, or mixtures thereof.

In another aspect of the present invention, the presence of a strong or a desirable flavor in the foodstuff also can be a notable and additional advantage. In one preferred embodiment of this invention, a browning and flavoring composition is particularly preferred to treat the susceptor when the foodstuff is a meat pie, because the resulting pie and pie crust have both a desirable brown color and a smokey flavor. A wide variety of food flavoring compositions can be used in the present composition to achieve this or other flavoring and/or browning effects. Other compositions containing hydroxyacetaldehyde and other browning and/or flavoring agents can be used in the present composition to achieve a desired browning and/or flavoring effect. For example, liquid smoke compositions, such as the CHARSOL® products available from Red Arrow Products LLC, Manitowoc, Wis., can be used to treat the susceptor for browning and flavoring the foodstuff.

The browning and/or flavoring composition also can contain other optional ingredients known to persons skilled in the art. For example, well known additives such as gums, thickeners, or preservatives, can be incorporated in the browning and/or flavoring compositions to provide a browning and flavoring most suitable for application to a particular type of susceptor. In a preferred embodiment, MAILLOSE® is sprayed onto a maltodextrin to provide a dry MAILLOSE® product. This dry MAILLOSE® product also can be admixed with other maltodextrins, a food starch, a hydrolyzed collagen, and/or a food gum, and any other desired optional ingredients.

In practicing the process of this invention, a variety of susceptors can be used. Susceptors suitable for treatment with a browning and/or flavoring composition include paper and cardboard, and are prepared by any of the methods well known in the art. For example, a cardboard box which contains the food product can be used to practice the present invention. Such susceptors can be porous, like paper or cardboard, to allow for absorption of the browning and/or flavoring material. Also suitable, however, are plastics, plastic films, and metal foils where the browning and/or flavoring composition is allowed to dry on a surface of the susceptor before storage, refrigeration, or freezing. Susceptors also can be made from various combinations of these materials. Suitable susceptors generally are flexible and thin, but can have a variety of thicknesses. Preferred susceptors have a relatively large surface area and are thin, because such susceptors make the browning and/or flavoring compositions more available to the foodstuff than a susceptor that is thick and has a small surface area. Suitable susceptors can be plain or patterned. Examples of susceptors are disclosed in U.S. Pat. Nos. 5,723,233; 5,698,306; and 5,614,259; Canadian Patent Application No. 2,230,432; European Patent Application No. 0 943 558; and WO 98/08752.

The browning and/or flavoring compositions can be applied dry or as liquid to achieve homogeneous application to a susceptor. The application of the browning and/or flavoring materials can be done singly, stepwise, or as a mixture. A variety of well known direct application techniques for liquids and solids, including, but not limited to, atomizing, sprinkling, pumping, dipping, soaking, passing the susceptor through a bath of the browning and/or flavoring composition, spraying, brushing, and coating, such as or roll-coating, are suitable to contact and adhere a browning and/or flavoring composition to a susceptor. For porous susceptors, the total contact time of the susceptor with the browning and/or flavoring composition typically determines the amount of material that the susceptor will incorporate.

In a preferred embodiment, the browning and/or flavoring composition can be applied to a surface of the susceptor by passing the susceptor through a bath of the browning and/or flavoring composition. The solution generally is allowed to soak into the susceptor for a sufficient time for the susceptor to incorporate the desired amount of material into the susceptor, then any excess browning and/or flavoring composition is removed. Removal of excess composition can be accomplished by inverting, blowing, wiping, or drying the susceptor. The susceptor can be dried or humidified before use or storage to adjust the liquid content such that it is suitable for further processing. The need for conventional drying or humidification after treatment depends on the liquid content of the susceptor after treatment and the type of susceptor. Preferably, the browning and/or flavoring composition does not run off the susceptor after application and prior to heating.

The susceptor described above can be subjected to additional process steps if necessary or desired. The use of additional steps is preferable when dry browning and/or flavoring compositions are used. In one embodiment, the susceptor first is contacted with a suitable liquid, then treated with a dry browning and/or flavoring composition. Preferably, the liquid allows the dispersion of 1 or more grams of browning and/or flavoring composition per 2 grams of liquid on a 144 $cm^2$ susceptor. Exemplary, but nonlimiting, liquids include a cooking oil, like corn oil, water, other liquids commonly applied to foodstuffs, and mixtures thereof. The liquid preferably has a sufficiently high viscosity to resist running off the susceptor or sufficiently low surface tension to spread on the susceptor, i.e., resists puddling.

In the dry application, it is preferred that the excess amounts of dry material are removed in order to provide a homogenous distribution of browning and/or flavoring composition. After removal of the excess dry powder, the remaining powder does not run or fall off of the susceptor prior to heating. Both liquid and dry application methods have excellent adherence to a susceptor, thereby facilitating an even distribution onto the foodstuff.

The resulting article is capable of imparting a brown color and/or flavor to a foods stuff, such as a bakery good, specifically a pie and pie crust, when a sufficient amount of the browning and/or flavoring composition is applied to the susceptor, followed by heating the susceptor in the presence of the foodstuff to complete processing of the treated foodstuff. The browning and/or flavoring composition so applied to a susceptor does not transfer to covered foodstuffs during storage. A foodstuff is not browned and/or flavored by simply contacting the foodstuff with the treated susceptor or positioning the foodstuff in the vicinity of the treated susceptor. Heating or cooking in the presence of the treated susceptor is required to brown the foodstuff. The susceptors, therefore, can be used immediately or can be stored, refrigerated, or frozen for extended periods, i.e., for at least several months, before heating at a later time.

The treated susceptors are especially useful when used with a dough-based foodstuff that is pre-prepared, then frozen, and eventually reheated in a microwave oven. The treated susceptors can be used on such pre-prepared foodstuffs because the browning and/or flavoring compositions applied to the susceptor are stable over time. The browning and/or flavoring composition applied via a susceptor overcomes the discoloration problem associated with a direct application of the browning and/or flavoring composition to the foodstuff. In particular, direct application of the browning and/or flavor composition to the foodstuff leads to a premature browning of the foodstuff that occurs during storage of the foodstuff, even at freezing temperatures.

Another aspect of the present invention is to provide a useful method of producing browned and/or flavored foodstuffs. The process includes volatilization of a suitable browning and/or flavoring composition adhered to a suitable susceptor in the presence of a foodstuff. Volatilization is a general term for the changing of a material from the liquid or solid phase to a gaseous phase. Volatilization occurs when the treated susceptor is heated. Upon heating a foodstuff in the presence of a treated susceptor to typical preparation temperatures, as obtained in a microwave oven for example, a desirable brown color and/or flavor is produced on the foodstuff. In preferred embodiments, the heating process produces a volatilized HAA and other browning and/or flavoring agents, which subsequently deposit or react on the surface of the foodstuff to result in a desirable brown color and/or smokey flavor.

Suitable heat sources include regular/conventional ovens, convection ovens, microwave ovens, toasters, other heating devices, or combinations thereof, although the use of microwave heating is preferred. Heating times of the foodstuffs in the presence of the treated susceptor is about one to about ten minutes, but preferably about 3 to about 8 minutes. In particularly preferred embodiments using HAA-containing browning and flavoring compositions, microwaving a treated susceptor to temperatures of at least about 40° C. for about 3 to about 8 minutes allows for sufficient HAA volatilization, condensation, and reaction to provide a desirable brown and/or flavor on the foodstuff. In other embodiments the temperature and time of heating depends on the effect desired, the specific type of foodstuff, and the particular conditions of preparing the foodstuff.

Another aspect of the present invention relates to the browned and/or flavored foodstuffs made by these methods. Foodstuffs which can be browned and flavored by the present invention include cheeses, meats, sausages and encased food products, poultry, fish, and bakery goods, such as biscuits, dinner rolls, pies, pie crusts, bagels, and puff pastries. The foodstuffs can be microwavable or nonmicrowavable. The high browning capability of the composition makes the treated susceptor particularly useful in browning foodstuffs, such as bakery products, that are cooked in a microwave.

The intensity of the brown color and/or flavor can be varied by adjusting the proximity of the foodstuff to the treated susceptor or by selectively covering a portion of the foodstuff. Browning and/or flavoring is not imparted to covered foodstuffs even when heated. In order to obtain the most consistent browning and/or flavoring, the susceptor is centrally positioned over or beneath the foodstuff. If the susceptor is not centrally postioned, the distribution of browning and/or flavoring composition and the resulting browning and/or flavoring may be uneven. For example, if the susceptor is placed in a corner of the microwave or food container, the portion of the foodstuff furthest removed from the susceptor may have a lighter to negligible amount of browning and/or flavoring compared to the portion of the foodstuff closer to the susceptor. The susceptor can be secured or unsecured proximal to the foodstuff for this purpose.

Another aspect of the present invention is to overcome the disadvantages associated with a traditional baking process, such as long baking times and excessive use of energy. The present browning and/or flavoring articles and methods allow foodstuffs to exhibit the esthetic qualities of a conventionally baked foodstuff, while offering the convenience, cost, and time savings of microwave cooking.

The following examples are provided to further illustrate specific aspects and embodiments of the present invention. These examples describe particular embodiments of the invention, but are not to be construed as limitations on the appended claims. Example 1 describes the browning of a microwavable pie using a cardboard susceptor which was prepared using a cooking oil solvent and a dry browning composition. Example 2 describes using water as the solvent. Example 3 describes a liquid browning composition application, and Example 4 describes the application of an alternative liquid browning composition. Example 5 describes the additional use of an optional surfactant. Example 6 describes selectively covering a foodstuff to selectively brown the foodstuff. Example 7 describes the browning of a "nonmicrowavable" foodstuff. Example 8 describes the use of filter pad disks as susceptors. Example 9 describes the asymmetric placement of the susceptor relative to the foodstuff. Example 10 describes the use of alternative browning compositions, and Example 11 describes browning and flavoring an alternative foodstuff.

EXAMPLE 1

A frozen microwavable pot pie (196 g, 12 cm diameter) packaged in a susceptor containing box (Fort James Paper Co., Richmond Va.) was removed from the box. The box was opened completely and laid flat with the susceptor (about 144 $cm^2$) facing up. A common cooking oil spray (2 grams) then was applied to the susceptor as an even layer. One gram of MAILLOSE® Dry, i.e., 0.1 grams of HAA, (Red Arrow Products LLC., Manitowoc, Wis.) was sprinkled evenly over the cooking oil. The dry browning material was absorbed by the oil and adhered to the susceptor. The box was reassembled and the pot pie was reinserted into the box. The pie then was then heated in a microwave oven (KitchenAid, 1000W, 30,000 $cm^3$ displacement) for the recommended time of 6 minutes. The heated pie had a uniform brown color across its entire surface. A control pie, with no MAILLOSE® Dry applied to the suseptor and microwaved the same way, had an inferior brown color that is unacceptable to many consumers.

EXAMPLE 2

A pot pie and box were treated as in Example 1, but rather than spraying with cooking oil, the susceptor was wetted with water by wiping the susceptor with a wet paper towel. One gram of MAILLOSE® Dry then was applied to the susceptor. The MAILLOSE® Dry did not adhere to the wet susceptor as well as the oil-treated susceptor of Example 1. The box then was tipped and the nonadhering MAILLOSE® Dry was blown off. One-half gram of MAILLOSE® Dry remained on the susceptor. The box, with the pie in it, then was reassembled and heated as in Example 1. After heating, the pie had a consumer acceptable level of browning over the entire surface of the pie. The heated pie was slightly lighter in color than the pie of Example 1, but was much browner than a control pie heated in absence of MAILLOSE® Dry.

EXAMPLE 3

A pot pie and box were treated as in Example 1, but MAILLOSE® liquid was sprayed onto the susceptor rather than cooking oil and MAILLOSE® Dry. One gram of the liquid browning composition (0.04 g of HAA) was applied evenly across the susceptor. The liquid browning composition did not adhere to the susceptor, but puddled. When the susceptor was moved, liquid browning composition ran off the susceptor. Due to insufficient adhesion of the browning composition to the susceptor, the box was not reassembled and the pie was not heated.

EXAMPLE 4

A pot pie and box were treated as in Example 3, but 0.5 g of MAILLOSE® 45 (0.11 g of HAA) was used rather than MAILLOSE® liquid. The MAILLOSE® 45 puddled, but adhered sufficiently to the susceptor. The pie was reboxed, then heated for 6 minutes, and examined. The heated pie had an acceptable brown color across the entire surface of the pie compared to a bland white control pie free of MAILLOSE® 45.

EXAMPLE 5

A pot pie and box were treated as in Example 3, but MAILLOSE® 45 with 1% JBR 425 surfactant (a solution of Rhamnolipids available from Jeneil Biosurfactant Company, Saukville, Wis.) was used. An even coating of MAILLOSE® 45 on the susceptor resulted. The pie then was reboxed and heated for 6 minutes. When examined, the, heated pie had a consumer acceptable brown color.

EXAMPLE 6

A pot pie and box were treated as in Example 5. Before microwaving, one inch of the pan side was cut away exposing a portion of the side crust of the pie. A sufficient amount of the pie pan remained to retain the integrity of the pie shape. The pie then was reboxed and heated for 6 minutes in the microwave. After heating, the pie was examined for color, and it was found that not only the top surface of the pie was browned, but the sides that were unprotected by the pie pan also were browned. Pies heated in the presence of a treated susceptor in which the pan side was not removed did not exhibit a brown side crust.

EXAMPLE 7

A nonmicrowavable pot pie was removed from its box. The box was unsealed and opened to expose the pie. MAILLOSE® 45 was added directly to the box top (about 169 $cm^2$) such that 0.4 g (0.088 g of HAA) was absorbed by the box. The pot pie was put into a microwavable pan and was reboxed into the treated box. The pot pie was heated for 6 minutes in a microwave, then examined. The pot pie had a cooked brown color on all surfaces not covered by the pan.

EXAMPLE 8

Filter pad disks (2 inch diameter) were dipped into MAILLOSE® 45 and allowed to air dry. The dry MAILLOSE® 45-treated disks absorbed 0.5 g of MAILLOSE® 45 solids (0.25 g of HAA). A frozen, non-microwavable blueberry pie (about 9 inch diameter) containing a dough crust was removed from its box. The box was unsealed and laid flat with the inside facing up. One dried MAILLOSE® filter pad disk was secured to the center of the box using adhesive tape, such that a minimum of the surface of the disk was covered. The pie was put into a microwavable pie container, reboxed in the box containing the filter pad disk and microwaved for 7.5 minutes. The heated pie had a uniform brown color across the top surface with the edges of the pie being slightly lighter in color than the center of the pie.

EXAMPLE 9

A blueberry pie and container were treated as in Example 8, but the treated disk was secured to the box top in a corner. The pie was microwaved as in Example 8, and had a brown color across the top surface of the pie, but had a darker color in an area near the corner where the treated disk was secured.

EXAMPLE 10

Five percent solutions of hydroxyacetaldehyde (HAA), methyl glyoxal (MG), glyceraldehyde (G), formaldehyde (F), 1,3-dihydroxyacetone (D), and glyoxal (L) were prepared. Seven nonmicrowavable pies and boxes were prepared by removing the pies, opening the boxes, and laying the boxes flat. Each pie was placed into a microwavable pie container. Each box was treated with one gram of one of the 5% solutions. The seventh box was an untreated control. The pies were reboxed, and each pie was individually microwaved for 6 minutes. The heated pies then were evaluated. The control pie was a bland white typical of a microwaved product. The G, F, D, and L pies lacked a brown color and were similar in appearance to the control pie. The MG-treated pie had a yellowish color that lacked consumer appeal. The HA-treated pie had a good baked brown color over the entire pie surface.

EXAMPLE 11

A regular, ready-to-use pie crust was cut into 10 $cm^2$ pieces. Three pieces were evenly stacked to provide some depth. One gram of SELECT 24 P, (a smoke flavoring available from Red Arrow Products Co. LLC.), was applied to, and spread evenly across, a susceptor (about 144 $cm^2$). The pie crust assembly was put into a box, with the susceptor being positioned on the top of the box. The box was closed, then the pie crust assembly was microwaved for 1.5 minutes and observed. The crust assembly was browned, and had a slightly smokey flavor.

The foregoing detailed description of the preferred embodiments of the invention has been given for clearness of understanding only, and no unnecessary limitations should be understood therefrom, as modifications will be obvious to those skilled in the art. Variations of the invention as hereinbefore set forth can be made without departing from the scope thereof, and, therefore, only such limitations should be imposed as are indicated by the appended claims.

What is claimed is:

1. A susceptor for use in a microwave oven comprising:

a) a porous, microwavable substrate selected from the group consisting of cardboard, paper, and cotton; and b) a food browning composition applied to at least one surface of the substrate in a sufficient amount to provide about 0.05 to about 0.5 mg of hydroxyacetaldehyde per square centimeter of substrate surface to impart a brown color to a foodstuff.

2. The susceptor of claim 1 wherein the food browning composition further comprises carboxyl compounds, phenols, and organic acids.

3. The susceptor of claim 1 wherein the food browning composition is absorbed by the surface of the substrate.

4. A susceptor for use in a microwave oven comprising:

a nonporous, microwavable substrate selected from the group consisting of plastic, metal, coated paper, and coated cardboard, and a food browning composition applied to at least one surface of the substrate in a sufficient amount to provide about 0.05 to about 0.5 mg of hydroxyacetaldehyde per square centimeter of substrate surface to impart a brown color to a foodstuff.

5. The susceptor of claim 4 wherein the food browning composition further comprises carboxyl compounds, phenols, and organic acids.

6. The susceptor of claim 4 wherein the food browning composition is present as a coating on the surface of the substrate.

* * * * *